US012226057B2

(12) United States Patent
Guidarelli

(10) Patent No.: US 12,226,057 B2
(45) Date of Patent: Feb. 18, 2025

(54) PORTABLE SHOWER CADDY

(71) Applicant: Joseph Guidarelli, Schenectady, NY (US)

(72) Inventor: Joseph Guidarelli, Schenectady, NY (US)

( * ) Notice: Subject to any disclaimer, the term of this patent is extended or adjusted under 35 U.S.C. 154(b) by 445 days.

(21) Appl. No.: 17/707,063

(22) Filed: Mar. 29, 2022

(65) Prior Publication Data

US 2023/0309757 A1 Oct. 5, 2023

(51) Int. Cl.
*A47K 3/28* (2006.01)
*A45C 5/00* (2006.01)
*A45C 15/04* (2006.01)

(52) U.S. Cl.
CPC ..... *A47K 3/281* (2013.01); *A45C 5/005* (2013.01); *A45C 15/04* (2013.01)

(58) Field of Classification Search
CPC ..... A45C 15/04; A45C 15/005; A47K 3/281
See application file for complete search history.

(56) References Cited

U.S. PATENT DOCUMENTS 1,111,397 A * 9/1914 Miller ..... A45C 13/06 150/123
1,578,778 A * 3/1926 Thornhill ..... A45C 7/0095 224/29.5
1,699,149 A * 1/1929 Mahler ..... A47B 67/005 132/316
2,457,918 A * 1/1949 Pierce ..... A47K 5/02 248/205.5
2,842,893 A * 7/1958 Howerton ..... A47K 5/02 206/77.1
4,164,968 A * 8/1979 Esposito, Jr. ..... A63B 60/58 224/607
D265,447 S * 7/1982 Harris ..... D6/553
4,611,716 A * 9/1986 Sorlien ..... A45D 27/22 132/316
D289,793 S * 5/1987 Blake ..... D23/309
D300,398 S * 3/1989 Krugman ..... D6/514
4,848,542 A * 7/1989 Burnette ..... G02B 7/182 428/912.2
4,943,018 A * 7/1990 Glaser ..... A47K 7/024 4/606
4,951,811 A * 8/1990 Lines ..... A45C 11/046 206/5
5,007,531 A * 4/1991 Lighten ..... A47K 5/02 206/823
5,020,673 A * 6/1991 Adams ..... A45C 3/00 150/112
D321,789 S * 11/1991 Martorella ..... D3/293
D337,467 S * 7/1993 Schmidt ..... D6/570
5,299,683 A * 4/1994 Poole ..... A47K 3/281 206/581

(Continued)

*Primary Examiner* — Ernesto A Grano
(74) *Attorney, Agent, or Firm* — Mitchell Law PLLC; Matthew W. Mitchell

(57) ABSTRACT

A shower caddy is disclosed. The shower caddy includes a first foldable cover, attached to a back cover via a first spine, the first spine defined by a first set of vertical fold lines, a second foldable cover, attached to the back cover via a second spine, the second spine defined by a second set of vertical fold lines, wherein the first and second foldable covers and the first and second spines comprises a surface having either a hook or a loop fastener.

16 Claims, 11 Drawing Sheets

(56) References Cited

U.S. PATENT DOCUMENTS 5,381,922 A * 1/1995 Gladman ..... A45F 5/02 D6/567
D364,519 S * 11/1995 Daughtry ..... D6/513
5,481,764 A * 1/1996 Nelson ..... A61F 5/37 4/559
D389,353 S * 1/1998 Patel ..... D6/513
5,779,033 A * 7/1998 Roegner ..... A45C 7/0095 206/6.1
5,878,672 A * 3/1999 Ostermann ..... B60N 3/004 297/188.06
5,915,545 A * 6/1999 Shackel ..... A45C 13/02 206/5
6,241,388 B1 * 6/2001 Terramani ..... A47K 3/281 206/581
6,264,029 B1 * 7/2001 Motson ..... A45C 11/00 206/472
6,325,077 B1 * 12/2001 Lark ..... A45C 11/008 132/316
D452,612 S * 1/2002 Alexandroff ..... D3/265
6,415,517 B1 * 7/2002 Worrick, III ..... B65D 77/2044 206/208
6,658,775 B1 * 12/2003 Lanzisero ..... G09F 3/203 40/605
6,708,961 B2 * 3/2004 Ferber ..... A61H 33/60 261/122.1
D499,287 S * 12/2004 Clute ..... D6/514
7,055,682 B1 * 6/2006 Domotor ..... A45C 13/02 206/214
7,984,697 B2 * 7/2011 Grbic ..... A01K 13/001 248/205.8
D679,091 S * 4/2013 Zidlick ..... D3/274
D727,026 S * 4/2015 Benn ..... D3/299
D805,800 S * 12/2017 Manzione ..... D6/514
10,674,874 B1 * 6/2020 Guidarelli ..... A45D 42/16
D998,995 S * 9/2023 Joseph ..... D6/567
11,827,182 B2 * 11/2023 Myers ..... B60R 7/043
2006/0242758 A1 * 11/2006 Hall ..... E03C 1/0408 4/601
2008/0035523 A1 * 2/2008 Lemire ..... A45C 13/26 206/774
2008/0185946 A1 * 8/2008 Meckert ..... A47B 97/00 312/259
2009/0145801 A1 * 6/2009 Moon ..... A47K 3/281 206/581
2011/0001332 A1 * 1/2011 Weber ..... B60J 3/0208 296/97.9
2013/0200118 A1 * 8/2013 Johnson ..... A45C 11/00 224/246
2013/0270206 A1 * 10/2013 Peck ..... A47G 23/0241 211/75
2013/0341216 A1 * 12/2013 Panzella ..... A47K 3/281 206/223
2014/0209493 A1 * 7/2014 Hale ..... A45C 15/06 206/281
2015/0143624 A1 * 5/2015 Irving ..... E03D 9/00 4/300.3
2016/0121706 A1 * 5/2016 Garfield ..... B60J 11/06 29/428
2020/0315407 A1 * 10/2020 Kennedy ..... A45D 44/16
2022/0386764 A1 * 12/2022 Jones-Moore ..... A45C 13/03

* cited by examiner

PORTABLE SHOWER CADDY

TECHNICAL FIELD

This disclosure relates to bath accessories and, in particular, to a shower caddy for portable transport of showering and toiletry supplies.

BACKGROUND

The statements in this section merely provide background information related to the present disclosure and may not constitute prior art.

Holders for articles such as toiletries are well known in the art. These holders encompass a variety of devices designed to hold various grooming and cleaning materials and devices. These holders are typically designed for traveling and therefore are small and sealable. These known holders are not intended for carrying into a shower, and therefore lack hanging means and water drainage features. Known portable shower caddies lack customizable pockets and accessory arrangements, i.e., you cannot orientate pockets or accessories as desired.

Hence, a need exists for a portable shower caddy having selectively arrangeable pockets and accessories.

SUMMARY

A shower caddy is disclosed. The shower caddy includes a first foldable cover, attached to a back cover via a first spine, the first spine defined by a first set of vertical fold lines, a second foldable cover, attached to the back cover via a second spine, the second spine defined by a second set of vertical fold lines, wherein the first and second foldable covers and the first and second spines comprises a surface having either a hook or a loop fastener.

One embodiment of the shower caddy includes a flexible cord or strap for hanging the shower caddy on a shower head. The flexible cord or strap can include a length adjustable clip.

One embodiment of the shower caddy includes at least one suction cup coupled to an attachment strip having a portion thereof having hook or a loop fastener for selective attachment to the surface.

One embodiment of the shower caddy includes a selectively detachable mirror having corresponding hook or loop fasteners for attachment to the surface, wherein the mirror is a mirror having opposed side margins and a width less than a total width of the back cover.

One embodiment of the shower caddy includes a selectively detachable pocket having mesh fabric. The selectively detachable pocket can include hook or loop fasteners corresponding to the surface for selective attachment thereto.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1A:
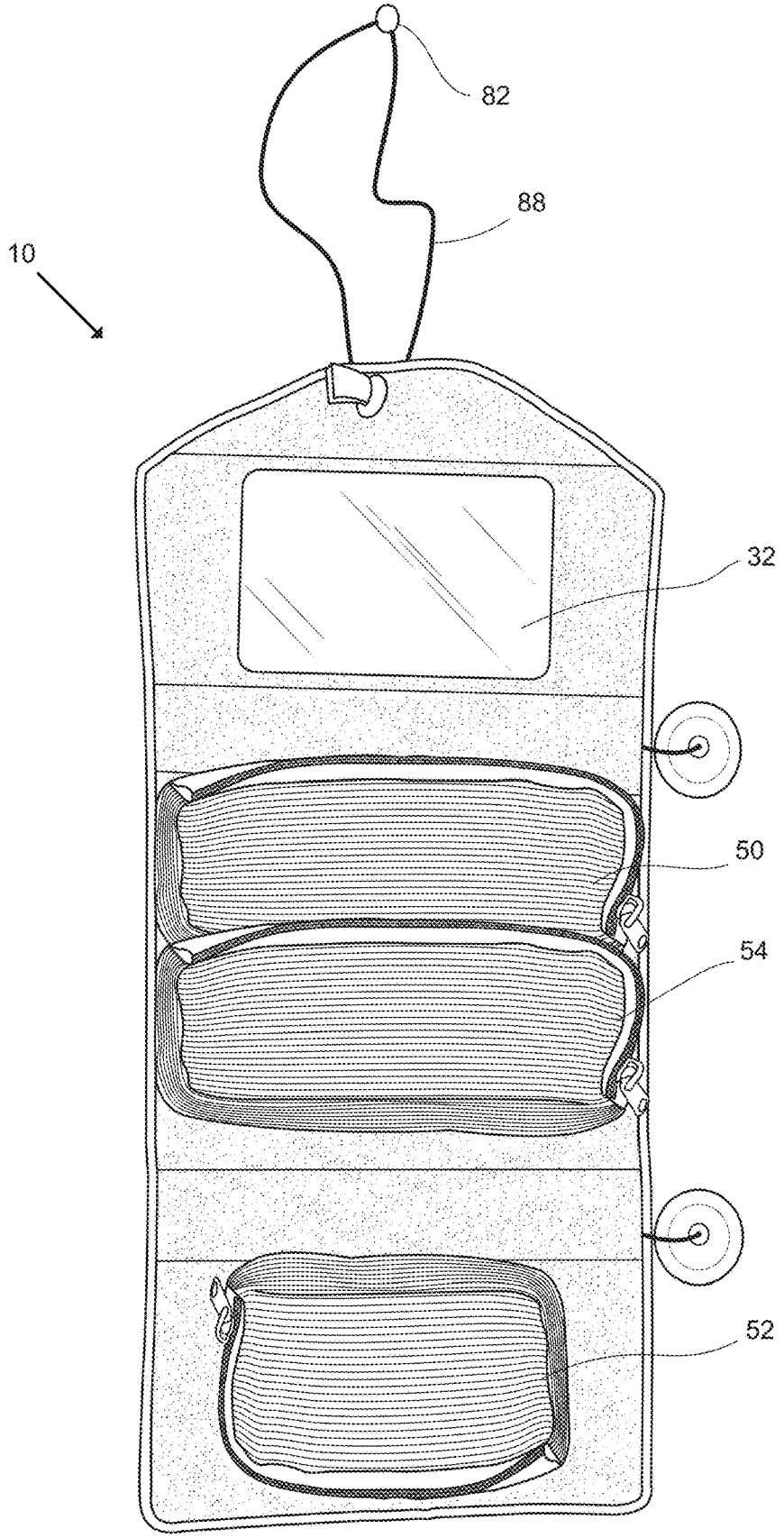
FIGS. 1A-1C show exemplary portable shower caddy in an open position, in accordance with the present disclosure.

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

As used in the description herein and throughout the claims, the following terms take the meanings explicitly associated herein, unless the context clearly dictates otherwise: the meaning of "a," "an," and "the" includes plural reference, the meaning of "in" includes "in" and "on." The term "based upon" is not exclusive and allows for being based on additional factors not described, unless the context clearly dictates otherwise. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner.

Figure 1B:
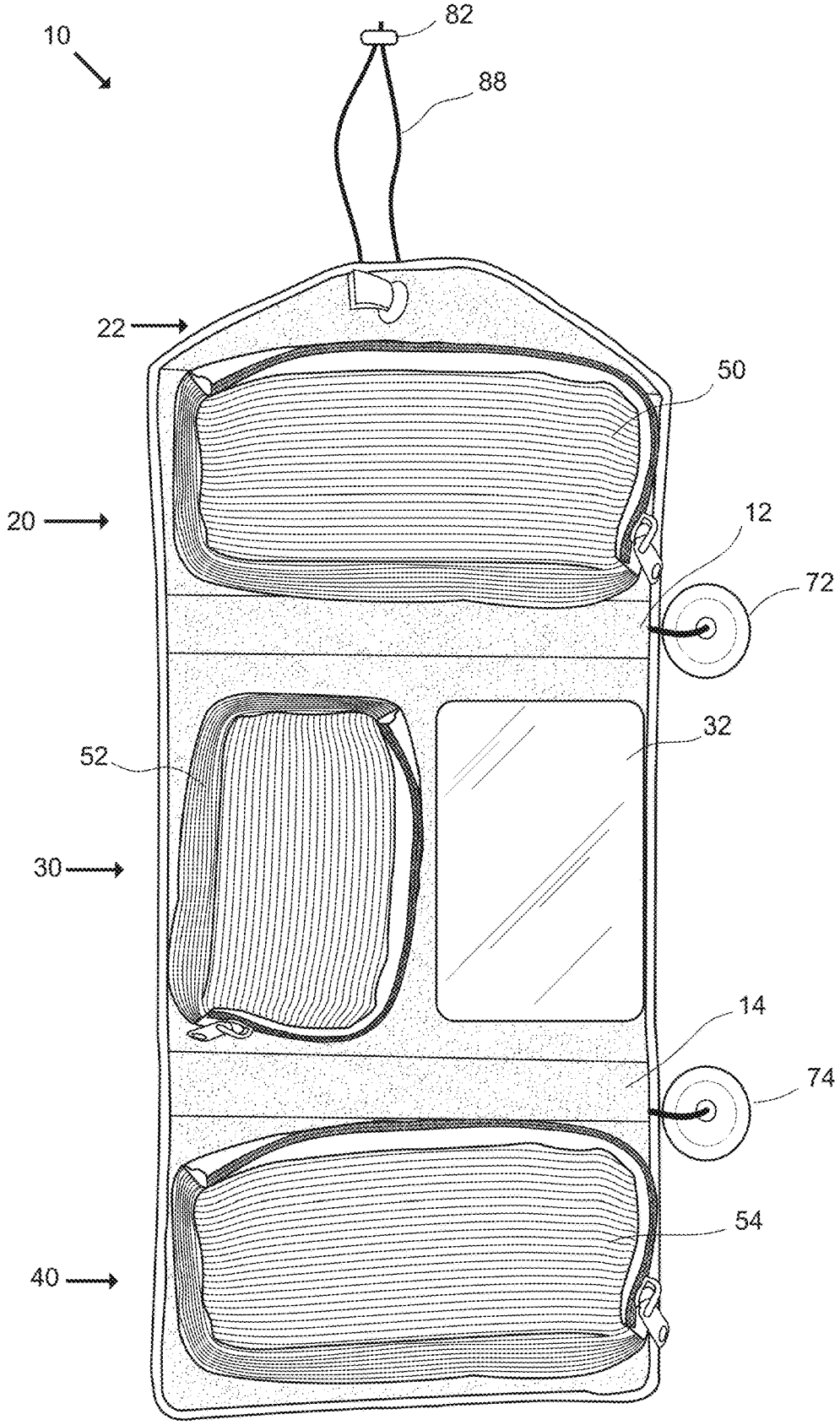
Figure 1C:
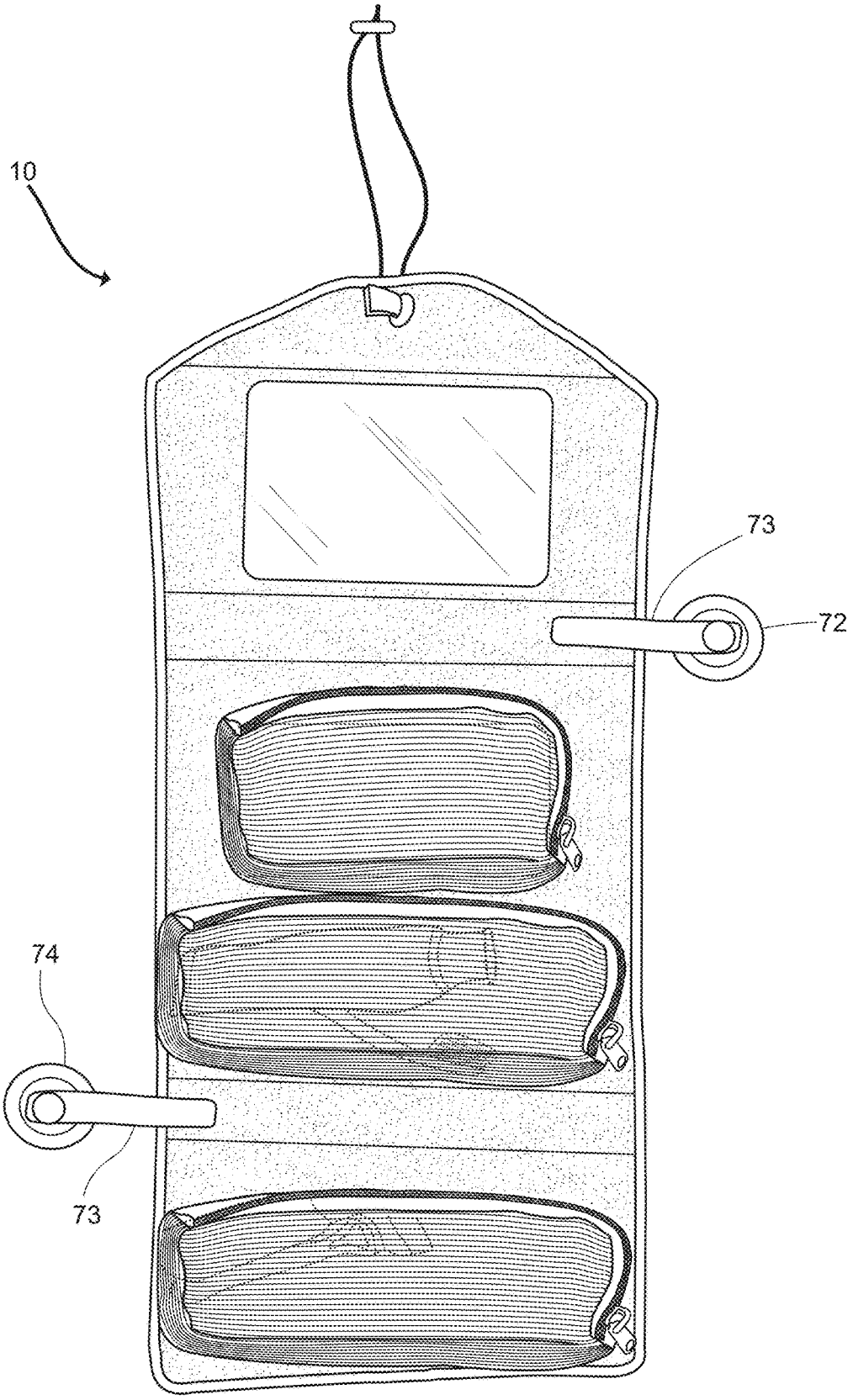
Figure 2:
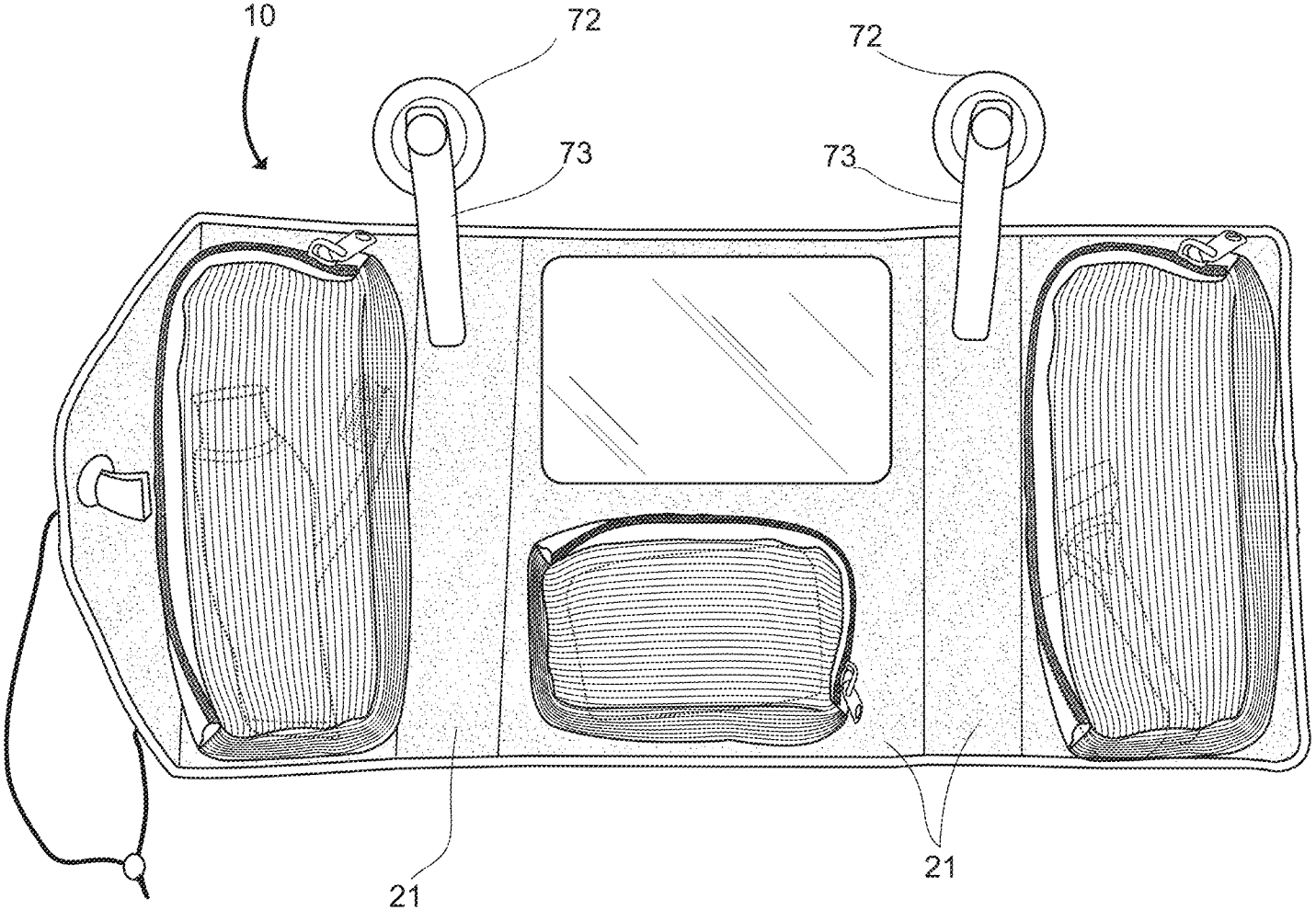
FIG. 2 is an exemplary plan view of the shower caddy in an open position to illustrate use, in accordance with the present disclosure.
Figure 3:
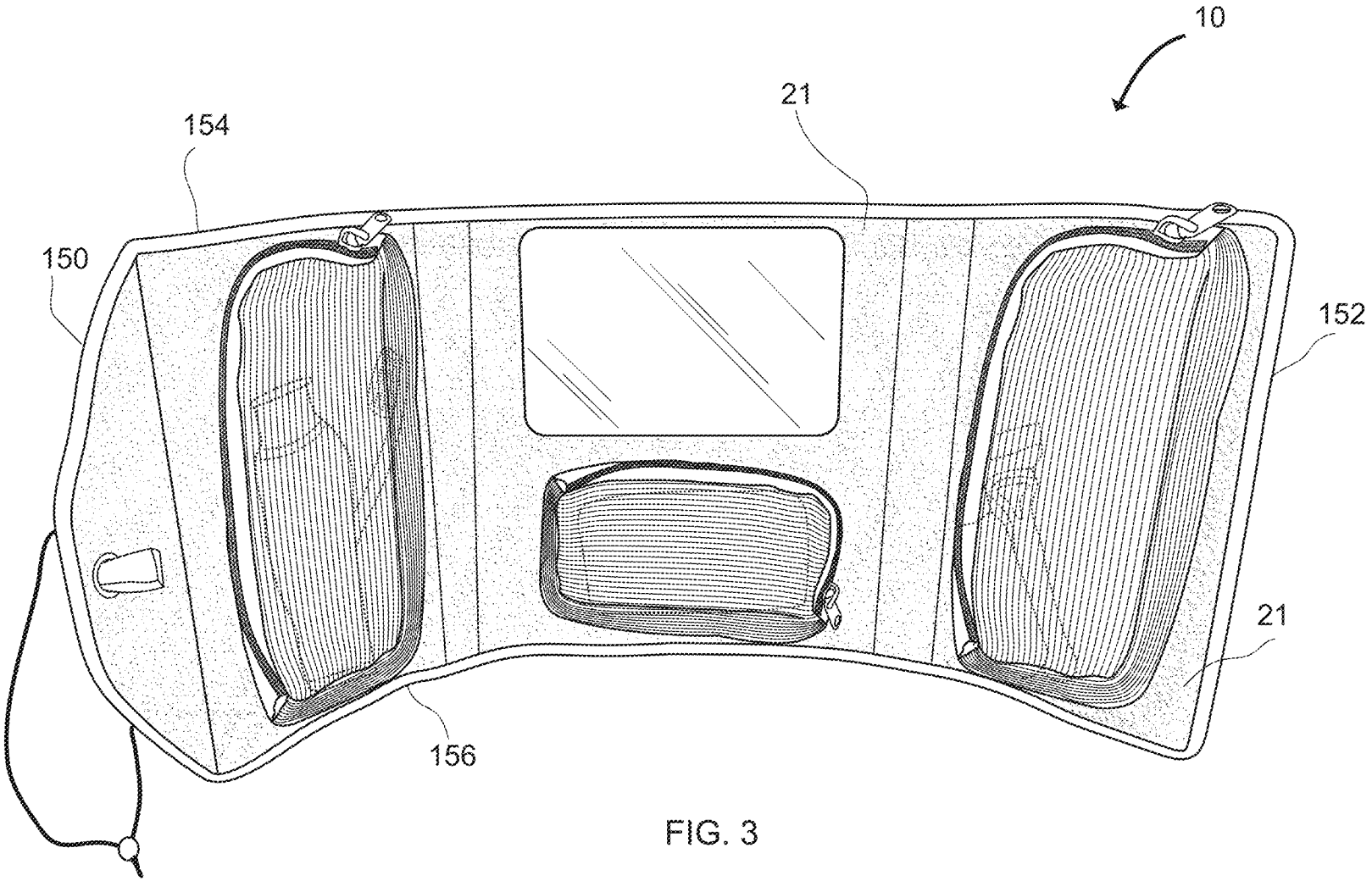
FIG. 3 is another view of the shower caddy in an open position, in accordance with the present disclosure.

Referring now to the drawings, wherein the depictions are for the purpose of illustrating certain exemplary embodiments only and not for the purpose of limiting the same, FIGS. 1-4B show an exemplary of the shower caddy 10 in an open position, from which a user may use the features thereof. As FIGS. 1-3 show, the shower caddy 10 is formed of three main sections: a first section 20, forming the left portion of the caddy 10, a second, main section 30, forming the middle portion, and a third section 40, forming the right portion of the caddy 10. A fourth portion 22 is preferably located at a top portion of the caddy 10.

As illustrated in FIGS. 1-4B, a shower caddy 10 is shown, which is formed to hold items such as toiletry and grooming items within its pockets 50, 52, and 54, a mirror 32, as described in greater detail herein below. The shower caddy 10 includes a first spine 12, a second spine 14, a first cover 16, and a second cover 18, a top cover 22, and a back cover 34. The first cover 16 is connected to the first spine 12 along a fold line 13. The back cover 34 is connected to the first spine 12 along a fold line 15, and connected to the second spine 14 along a fold line 17. The second cover 18 is connected to the second spine 14 along a fold line 19. The top cover 22 is connected to the first cover 16 along a fold line 11.

The spines 12 and 14, and the covers 16, 18, 22, and 34 define the outer edges of the shower caddy 10, i.e., a left-side edge 150, a right-side edge 152, a top edge 154, and a bottom edge 156.

The first spine 12, second spine 14, first cover 16, second cover 18, top cover 22, and the back cover 34 are each preferably formed of a relatively rigid and continuous material to give the respective covers and the spines a body with dimensions. The respective inner bases provide structural support, yet are somewhat flexible so that the covers are able to bend or slightly contour around the items being held with some resistance. In one embodiment, the spines 12 and 14, and the covers 16, 18, 22 and 34 are formed of a silicon-based material.

In one embodiment, first spine 12, second spine 14, first cover 16, second cover 18, top cover 22, and the back cover 34 each include an inner plate and an outer material. In one embodiment, first spine 12, second spine 14, first cover 16, second cover 18, top cover 22, and the back cover 34 are formed of a continuous, integral material, which is pinched to form the fold lines 11, 13, 15, 17, and 19. In one embodiment, wherein the first spine 12, second spine 14, first cover 16, second cover 18, top cover 22, and the back cover 34 each include an inner plate or a single continuous integral plate that is pinched is used, the inner plate(s) are formed of marine grade canvas. The inner plate(s) provide structural support and are relatively flexible. Each inner plate extends substantially throughout the complete width and length of each of the first spine 12, second spine 14, first cover 16, second cover 18, top cover 22, and the back cover 34.

In one embodiment, an enclosure or shell is fabricated enclosing the inner plate(s) to form the spines 12 and 14 and the covers 16, 18, 22, and 34. Preferably, the shell is formed from a woven fabric material which can be treated with a UV resistant and water-repellent coating. The fabric material may be formed from canvas, nylon, polyester, or polyvinyl chloride. The shower caddy 10 may be any size, but in one embodiment is sized and adapted to accommodate travel and/or regular-sized toiletry and grooming items.

Figure 4A:
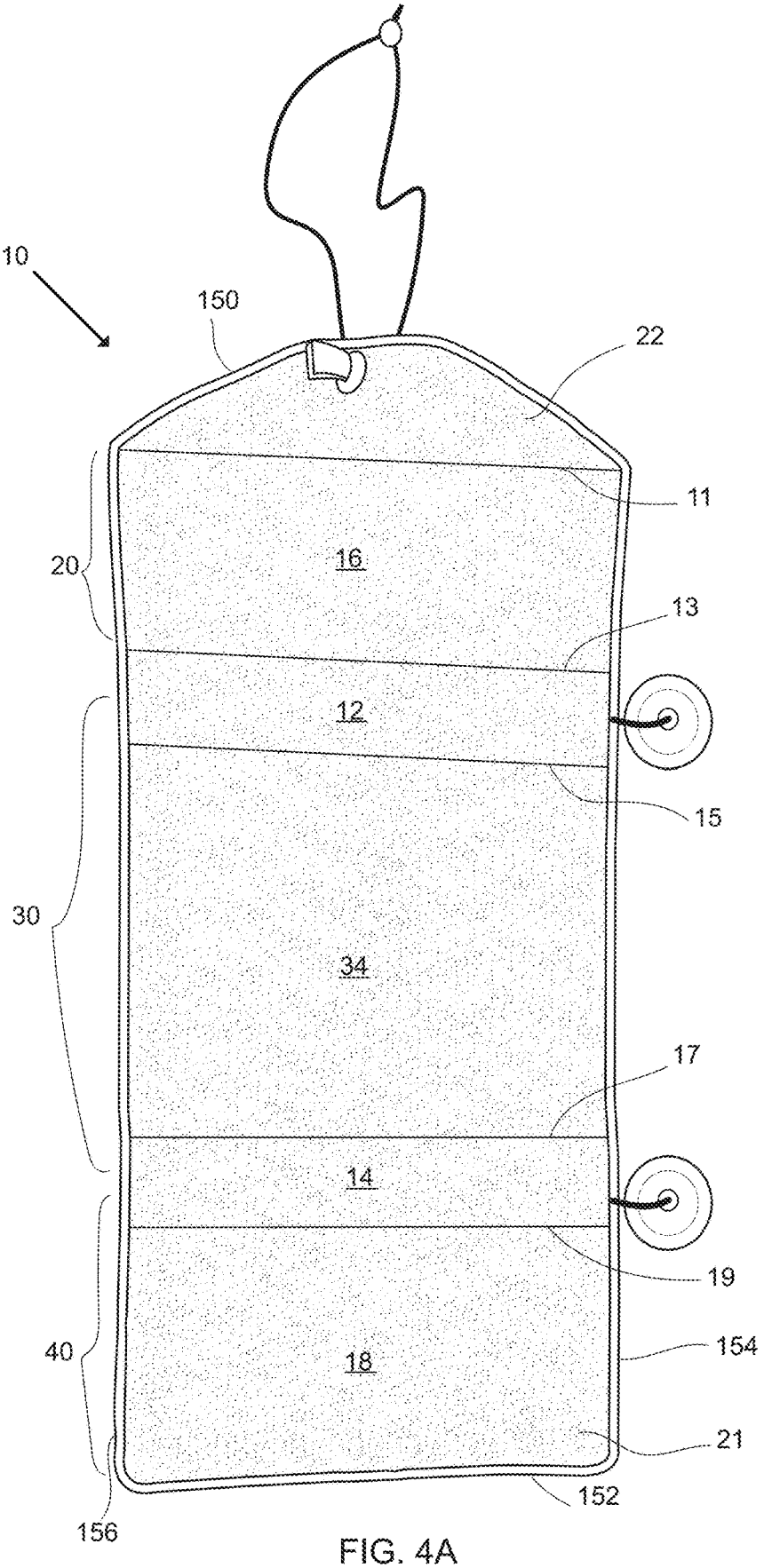
FIG. 4A is a front view of part of the shower caddy in an open position, in accordance with the present disclosure.

FIG. 4A is a top plan view of the interior of the shower caddy 10 without pockets or accessories. As FIG. 4A shows, an interior surface 21 of the shower caddy 10 can include either hooks or loops as part of a hook and loop fastening system such as Velcro®. The surface 21 that includes hooks or loop fasteners may be defined by the edges 150, 152, 154, and 156.

In one embodiment, surfaces of the spines 12 and 14 and the covers 16, 18, 22, and 34 include hooks or loops fasteners. Pockets and accessories such as the pockets 50, 52, and 54, and the mirror 32 include strips of either a hook or loop configured to selectively detach from the hooks or loops on the interior surface of the shower caddy 10. In one embodiment, the strips of hooks or loops is adhered to the pockets and accessories such as the pockets 50, 52, and 54, and the mirror 32 using adhesive, but may be threaded or coupled in one or more known ways.

The pockets 50, 52, and 54 can include mesh fabric and a closing mechanism such as a zipper. However, any conventional fastener may be utilized, such as a snap fastener, buttons, clasps, buttons, hook and loop fastener, and/or magnetic closures.

The pockets 50, 52, and 54 functions to store and carry items within the shower caddy 10. The mesh fabric material allows a user to visually check quickly to determine if a particular item is within the shower caddy 10, and aids in water drainage and reduced drying time. The pockets 50, 52, and 54 are preferably flexible and resilient so that items may be easily inserted through an opening and held within the pocket, and conversely easily taken out of the pocket through the opening. In one embodiment, a pocket may be coupled to the exterior surface of the shower caddy 10 along most any position or angle. That is, the placement of the pocket is not limited to the inside covers and spines as illustrated nor the dimensions and positions.

The pockets 50, 52, and 54 may be constructed in several manners such as, but, not limited to a permanent mesh type material for holding products, a detachable mesh, or, net type material, a permanent vinyl, or, flexible plastic, a rigid, or stiff, yet, pliable and retractable plastic and any other type of compartmental type of holding apparatus. In one embodiment, one or more of the pockets 50, 52, and 54 are provided having waterproof sealing and made of transparent material for enclosure of a mobile device, such as a cell phone. In this way, a user may use the mobile device by viewing through the pocket. In one embodiment of the caddy 10, a water resistant or water proof speaker may be attached for selective communication with a mobile device. In this way, a user may keep the mobile device out of the water, while still directing music or other audio to a user in proximity to the wet environment, i.e., shower.

As FIGS. 1A-1C and FIG. 3 show, the pockets 50, 52, and 54 can be selectively detached and reattached in any desired position on the interior surface. In this way, a preferential arrangement of the pockets 50, 52, and 54 and accessories can be achieved. For example, one may desire a particular arrangement of the pockets 50, 52, and 54 and accessories while in the shower, and another arrangement when using the shower caddy 10 in an upright position such as shown in FIG. 3. Removing the pockets 50, 52, and 54 can make loading and unloading items within the pockets 50, 52, and 54 easier.

In one embodiment, the shower caddy 10 selectively includes a mirror 32 on an inner surface of the back cover 34 of the main section 30. The mirror 32 formed of reflective, light-weight, flexible material. In one embodiment, the mirror 32 is a steam-resistant or fogless mirror. In one embodiment, the mirror 32 can be formed from plexiglass material. As described hereinabove, the mirror 32 may be attached and detached to the surface 21.

Figure 5A:
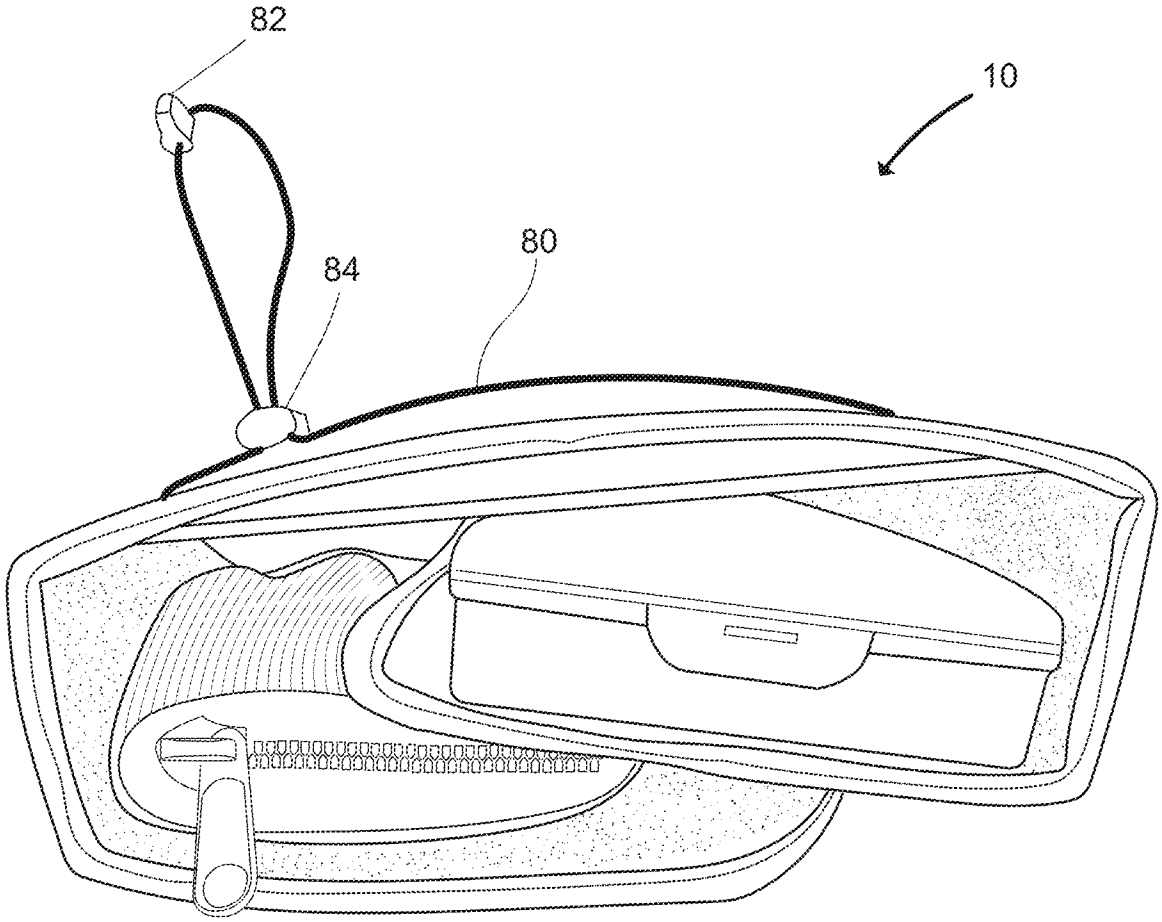
FIGS. 5A and 5B are perspective views of the shower caddy in a closed position, in accordance with the present disclosure.
Figure 5B:
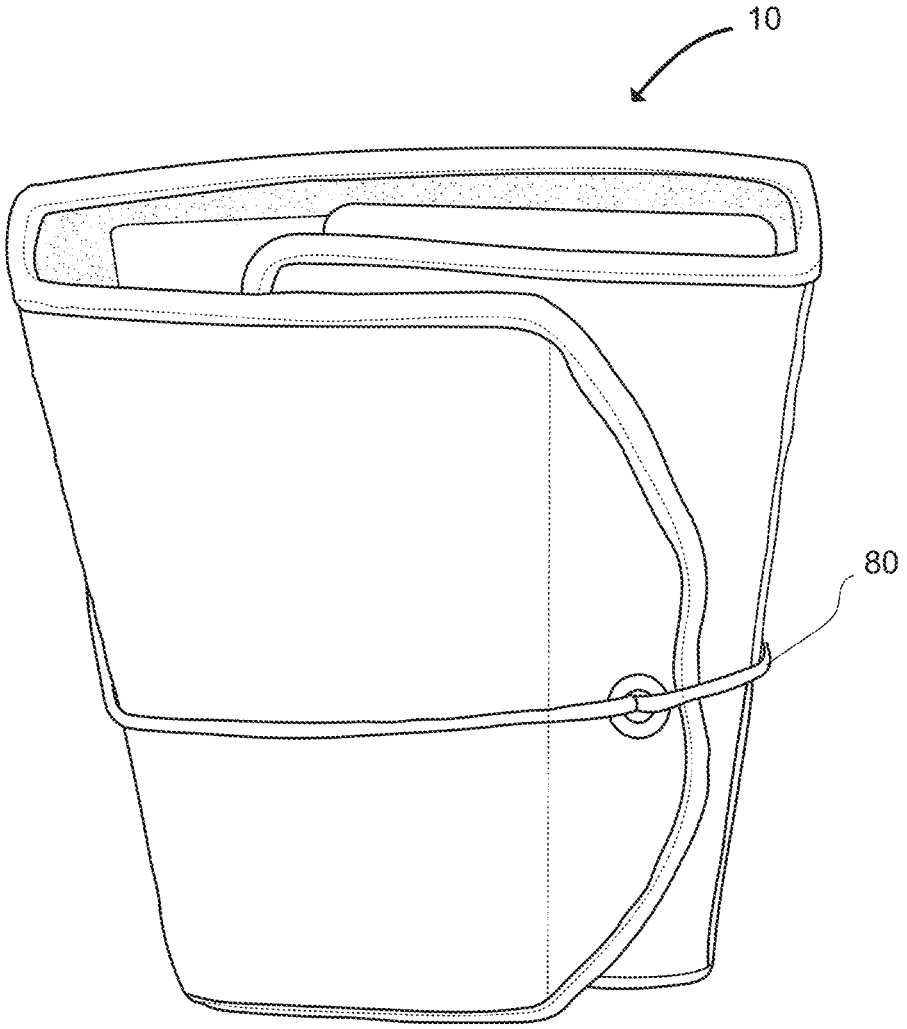

The shower caddy 10 preferably includes a closure mechanism 80 which may be a zipper, string and eyelets, a hook and loop fastener system, or another suitable closure mechanism. The shower caddy 10 preferably includes a cord or strap 80 for hanging the caddy 10 such as on a shower head and for keeping the caddy 10 closed. The strap 80 can be attached to the caddy 10 at through an eyehole or aperture in the cover 22. In one embodiment, the strap 80 includes a knot or a clip 82 at one end to prevent the strap 80 from slipping through the aperture. In one embodiment, the strap 80 is length adjustable via a clip 84, which is configured to lock a selected cord length in place. The strap 80 is preferably formed of a resilient, elastic material so that the user can stretch the strap 80 around the caddy 10 such as shown in FIGS. 5A and 5B to keep in the closed position. In one embodiment, the strap 80 can be formed of a hook and loop material, having hooks on one side and loops on the other so that one can fold and couple the strap 80 onto itself.

In one embodiment, a hook and loop fastener system is used to secure the caddy 10 into a closed position. The hook and loop fastener can include a flap and a corresponding strip. In one embodiment, the flap is adhered to the cover 16, while the strip is adhered to the cover 18. To close, the cover 18 is folded, and the cover 16 is folded over cover 18, to which the flap is pulled and selectively adhered to the strip.

Figure 6A:
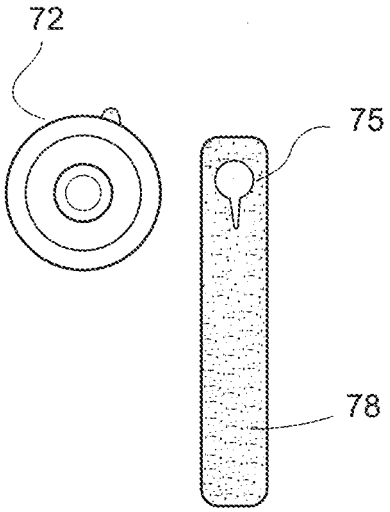
FIG. 6A-6C show an exemplary suction cup and strap for selective attachment to the shower caddy, in accordance with the present disclosure.
Figure 6B:
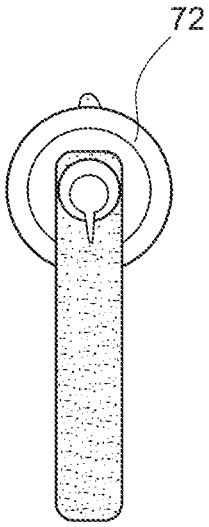
Figure 6C:
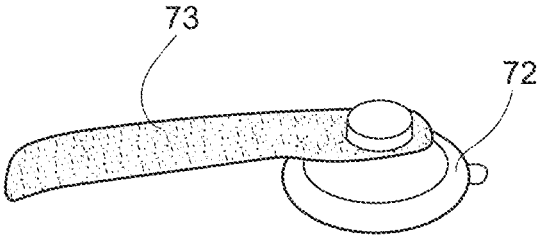
Figure 7A:
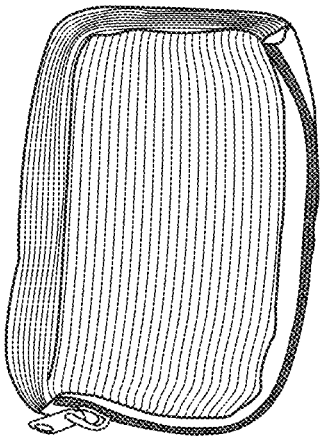
FIGS. 7A-7D show exemplary pockets and a mirror detached from the shower caddy, in accordance with the present disclosure.
Figure 7B:
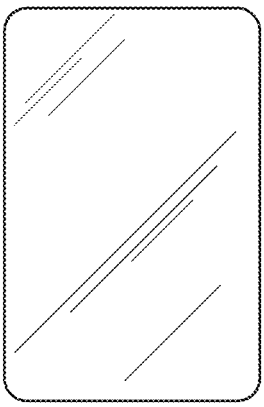
Figure 7C:
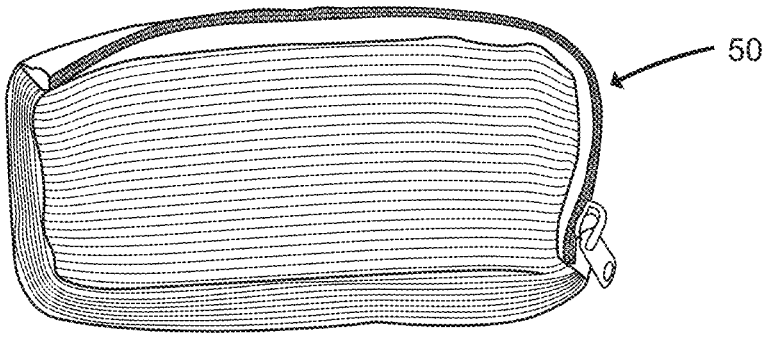
Figure 7D:
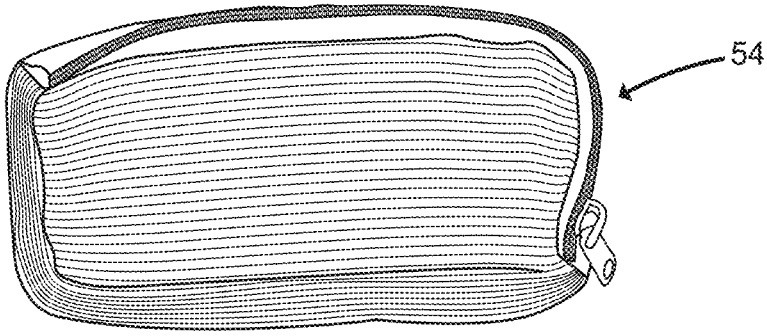

FIGS. 6A-6C show an exemplary suction cup 72 and attachment strip 73. The suction cup 72 and attachment strip 73 are selectively removeable via an opening 75. The opening 75 is configured to selectively form around a protrusion of the suction cup 72, coupling the suction cup 72 to the strip 73. The strip 73 preferably includes a surface 78 having hook or loop fasteners to selectively attach to the surface 21 of the shower caddy 10. The opening 75 can be formed of any number of shapes includes as shown, a circular opening, and/or a slit much like a button hole. In one embodiment, the attachment strips 73 are formed of a surface 78 with hook or loop fasteners, and then an opposing surface with corresponding hook or loop fasteners, e.g., hook fasteners on a first side, and loop fasteners on the opposing side.

Selective attachment of the suction cup 72 and attachment strip 73 to the surface 21 enables a user to place the suction cup 72 and attachment strip 73 where desired. For example, when hanging the shower caddy 10 in a vertical position, such as when the shower caddy 10 is hung on a shower head, a user may want to place the suction cup 72 and attachment strip 73 on a left and a right side, such as shown in FIG. 1C. When using the shower caddy 10 in a horizontal position, such as shown in FIG. 2, a user may place the suction cup 72 and attachment strip 73 on one side of the surface 21.

The suction cups 72 and 74 secure the caddy 10 to a shower wall, or other flat vertical surface, and generally may function to inhibit tilting of the caddy 10. The suction cups 72 and 74 are composed of a waterproof material, which may include any of a variety of different elastomeric materials, which are known in the art. The suction cups 72 and 74 may be attached to the shower caddy 10 in other positions and via other mechanical means. The caddy 10 can include any number of additional suction cups and strips 73.

The shower caddy 10 can be positioned for use in different orientations and positions. As described hereinabove, the caddy 10 can be hung vertically or horizontally on a shower head or may be suctioned to a wall in the vertical or horizontal positions. A user may also position the caddy in a "free standing" on a table, counter, or other flat surface in the position such as shown in FIG. 3.

Figure 4B:
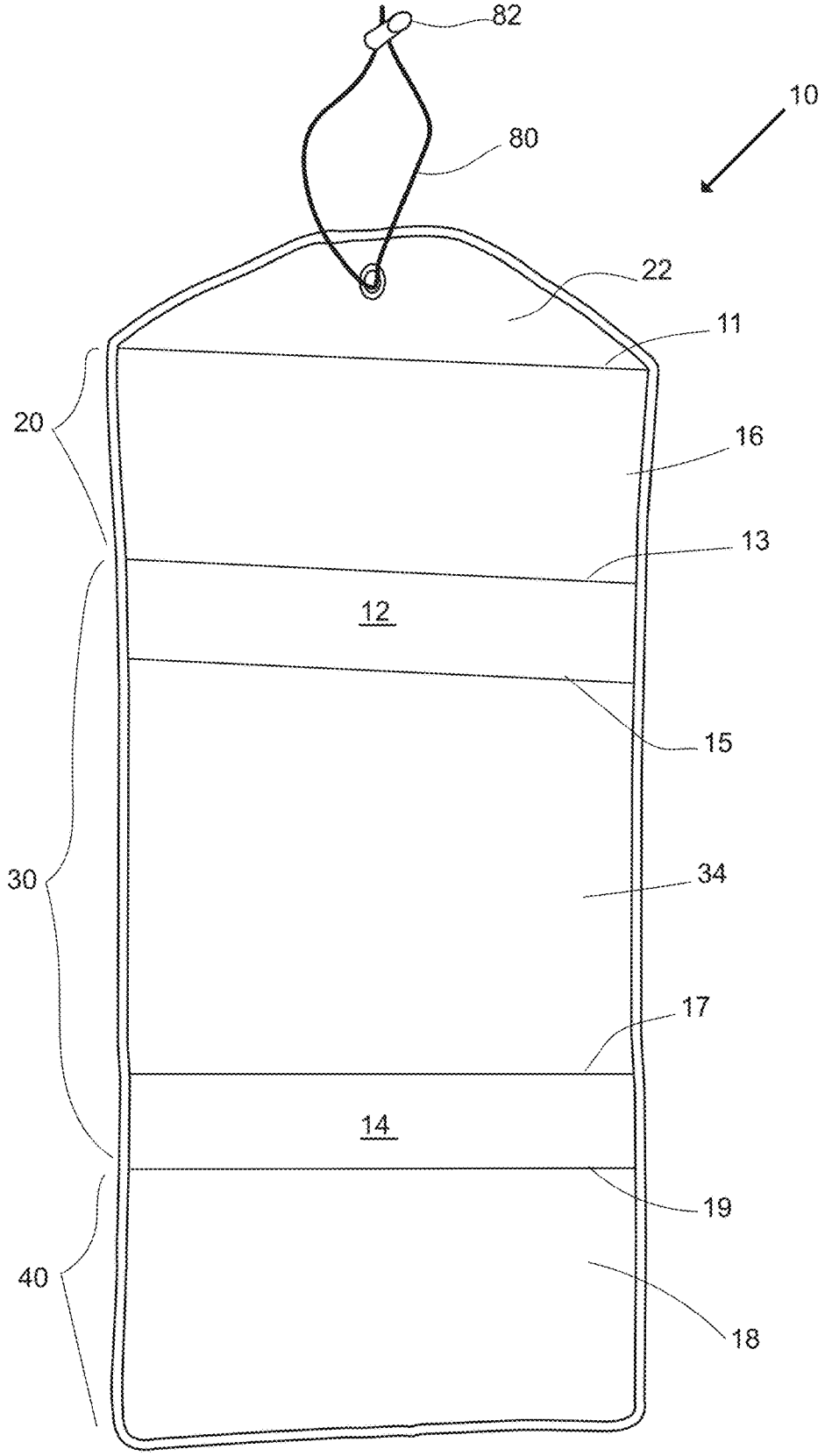
FIG. 4B is a rear view of part of the shower caddy in an open position, in accordance with the present disclosure.

FIG. 4B shows the exterior of the caddy 10. The exterior can include a logo, design or other indicia for branding or decorative purposes.

Many additional accessories can be attached to the caddy 10 via hook or loop fasteners. For example, lights, mobile device covers, and/or speakers.

Examples in this specification where one element is "coupled" or "connected" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. Further, the term "plurality" can be defined as "at least two."

While the foregoing disclosure discusses illustrative embodiments, it should be noted that various changes and modifications could be made herein without departing from the scope of the described embodiments as defined by the appended claims. Accordingly, the described embodiments are intended to embrace all such alterations, modifications and variations that fall within scope of the appended claims. Furthermore, although elements of the described embodiments may be described or claimed in the singular, the plural is contemplated unless limitation to the singular is explicitly stated. Additionally, all or a portion of any embodiment may be utilized with all or a portion of any other embodiments, unless stated otherwise.

The invention claimed is:

1. A shower caddy, comprising:

a first foldable cover, attached to a back cover via a first spine, the first spine defined by a first set of vertical fold lines;

a second foldable cover, attached to the back cover via a second spine, the second spine defined by a second set of vertical fold lines, wherein the first and second foldable covers and the first and second spines comprises a surface having either a hook or a loop fastener; and at least one suction cup coupled to an attachment strip having a portion thereof having hook or a loop fastener for selective attachment to the surface.

2. The shower caddy of claim 1, further comprising:

a selectively detachable mirror having corresponding hook or loop fasteners for attachment to the surface, wherein the mirror is formed plexiglass material having opposed side margins and a width less than a total width of the back cover.

3. The shower caddy of claim 1, further comprising:
a selectively detachable pocket having mesh fabric.

4. The shower caddy of claim 1, further comprising:
a flexible cord or strap for hanging the shower caddy on a shower head.

5. The shower caddy of claim 4, wherein the flexible cord includes a length adjustable clip.

6. The shower caddy of claim 1, wherein the shower caddy further comprises a third foldable cover.

7. The shower caddy of claim 6, wherein the third foldable cover shares a fold line with the first foldable cover.

8. The shower caddy of claim 6, wherein the third foldable cover comprises an aperture configured to selectively receive a flexible cord or strap.

9. A shower caddy, comprising:
a first foldable cover, attached to a back cover via a first spine, the first spine defined by a first set of vertical fold lines;
a second foldable cover, attached to the back cover via a second spine, the second spine defined by a second set of vertical fold lines;
a third foldable cover, attached to the first foldable cover at a vertical fold line,
wherein the first, second, and third foldable covers and the first and second spines comprises a surface having either a hook or a loop fastener; and
at least one suction cup coupled to an attachment strip having a portion thereof having hook or a loop fastener for selective attachment to the surface.

10. The shower caddy of claim 9, wherein the third foldable cover shares a fold line with the first foldable cover.

11. The shower caddy of claim 9, wherein the third foldable cover comprises an aperture configured to selectively receive a flexible cord or strap.

12. The shower caddy of claim 9, further comprising:
a selectively detachable mirror having corresponding hook or loop fasteners for attachment to the surface, wherein the mirror is formed plexiglass material having opposed side margins and a width less than a total width of the back cover.

13. The shower caddy of claim 9, further comprising:
a selectively detachable pocket having mesh fabric.

14. The shower caddy of claim 9, further comprising:
a flexible cord or strap for hanging the shower caddy on a shower head.

15. The shower caddy of claim 14, wherein the flexible cord includes a length adjustable clip.

16. A shower caddy, comprising:
a first foldable cover, attached to a back cover via a first spine, the first spine defined by a first set of vertical fold lines, wherein the first foldable cover and the first spine are generally rectangular-shaped;
a second foldable cover, attached to the back cover via a second spine, the second spine defined by a second set of vertical fold lines, wherein the second foldable cover and the second spine are generally rectangular-shaped; and
a third foldable cover, attached to the first foldable cover at a vertical fold line, wherein the third foldable cover shares a fold line with the first foldable cover, and wherein the third foldable cover comprises an aperture configured to selectively receive a flexible cord or strap, and wherein the first, second, and third foldable covers and the first and second spines comprises a surface having either a hook or a loop fastener; and
a flexible cord or strap for hanging the shower caddy on a shower head, wherein the flexible cord includes a length adjustable clip;
at least one suction cup coupled to an attachment strip having a portion thereof having hook or a loop fastener for selective attachment to the surface;
a selectively detachable mirror having corresponding hook or loop fasteners for attachment to the surface, wherein the mirror is formed plexiglass material having opposed side margins and a width less than a total width of the back cover; and
a selectively detachable pocket having mesh fabric, wherein the selectively detachable pocket includes hook or loop fasteners corresponding to the surface for selective attachment thereto.

* * * * *